US007258199B2

(12) United States Patent
Hayes, Sr.

(10) Patent No.: US 7,258,199 B2
(45) Date of Patent: Aug. 21, 2007

(54) MODULAR MULTILEVEL ACCESS PLATFORM AND METHOD FOR ERECTING THE SAME

(75) Inventor: Richard Hayes, Sr., 275 Sheldon Ave., Staten Island, NY (US) 10312-2909

(73) Assignee: Richard Hayes, Sr., Staten Island, NY (US)

( * ) Notice: Subject to any disclaimer, the term of this patent is extended or adjusted under 35 U.S.C. 154(b) by 261 days.

(21) Appl. No.: 10/854,138

(22) Filed: May 27, 2004

(65) Prior Publication Data

US 2005/0263351 A1 Dec. 1, 2005

(51) Int. Cl.
*E04G 7/00* (2006.01)

(52) U.S. Cl. ..... 182/178.1; 182/222; 182/223

(58) Field of Classification Search ..... 182/178.1, 182/222, 223, 42
See application file for complete search history.

(56) References Cited

U.S. PATENT DOCUMENTS

| | | | | |
|---|---|---|---|---|
| 2,438,173 A | | 3/1948 | Johnson et al. | |
| 3,221,837 A | * | 12/1965 | Fisher | 182/115 |
| 3,228,154 A | * | 1/1966 | Mulitz | 52/185 |
| 3,305,046 A | * | 2/1967 | Schar | 182/179.1 |
| 3,454,131 A | * | 7/1969 | Johnson et al. | 182/115 |
| 3,565,212 A | * | 2/1971 | Johnson | 182/222 |
| 3,768,016 A | * | 10/1973 | Townsend et al. | 455/25 |
| 3,788,018 A | * | 1/1974 | Simmons et al. | 52/185 |
| 3,859,771 A | * | 1/1975 | Simmons et al. | 52/741.2 |
| 3,901,532 A | | 8/1975 | Hornagold | |
| 4,084,777 A | | 4/1978 | Lambert | |
| 4,253,549 A | | 3/1981 | Petren | |
| 4,397,373 A | | 8/1983 | Ream et al. | |
| 4,759,162 A | | 7/1988 | Wyse | |
| 4,773,506 A | | 9/1988 | Preston | |
| 4,825,192 A | | 4/1989 | Wells | |
| 4,858,726 A | | 8/1989 | Preston | |
| 4,930,273 A | | 6/1990 | Papesch | |

(Continued)

FOREIGN PATENT DOCUMENTS

JP 2002-38718 2/2002

OTHER PUBLICATIONS

Occupational Safety and Health Administration, A Guide to Scaffold Use in the Construction Industry, Small Business Safety Management Series, OSHA 3150 2002 (Revised).

*Primary Examiner*—Richard E. Chilcot, Jr.
*Assistant Examiner*—Lindsay M. Maguire
(74) *Attorney, Agent, or Firm*—Bacon & Thomas, PLLC

(57) ABSTRACT

A multilevel access platform comprising a plurality of stackable modules. Each module includes elongated column members that are generally parallel and coextensive, and a plurality of levels of elongated lateral members that extend transversely between and are connected to the column members. Each level of the lateral members is located at vertically spaced positions relative to the column members and each of the lateral members border a side of the module. At least one platform section is provided for each level and is supported by one level of the lateral members. The stackable modules include a staircase that extends between each level of the lateral members. The multilevel access platform includes a base assembly provided to stabilize and independently secure the multilevel platform. A method for erecting the multilevel access platform includes the step of stacking each module to meet a desired height of a building construction.

24 Claims, 15 Drawing Sheets

U.S. PATENT DOCUMENTS

| | | | | |
|---|---|---|---|---|
| 4,967,875 | A | 11/1990 | Beeche | |
| 5,127,492 | A | 7/1992 | Preston | |
| 5,335,468 | A | 8/1994 | Oberman et al. | |
| 5,491,939 | A * | 2/1996 | Wang | 52/185 |
| 5,617,931 | A | 4/1997 | Zygmun et al. | |
| 6,415,891 | B1 | 7/2002 | Hayman et al. | |
| 6,464,196 | B1 | 10/2002 | Crookham et al. | |
| 6,539,571 | B1 | 4/2003 | Forsyth | |
| 6,648,102 | B2 | 11/2003 | Bostelman et al. | |
| 2003/0150187 | A1 | 8/2003 | Forsyth et al. | |
| 2003/0178253 | A1 | 9/2003 | Tatge et al. | |

* cited by examiner

FIG. 15
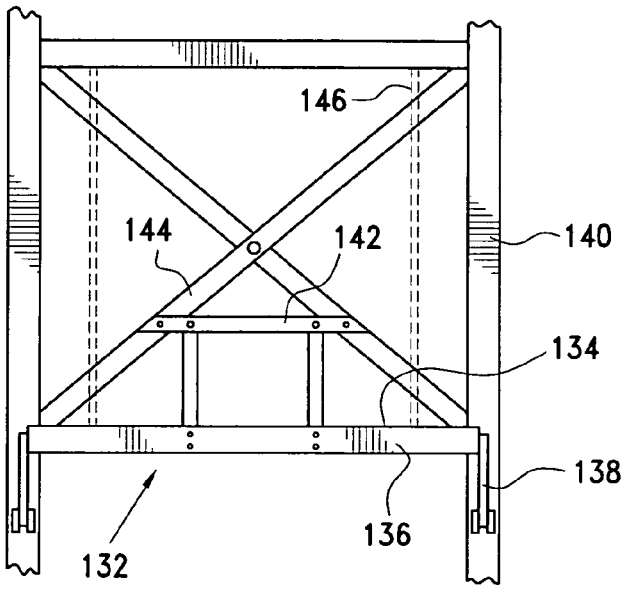
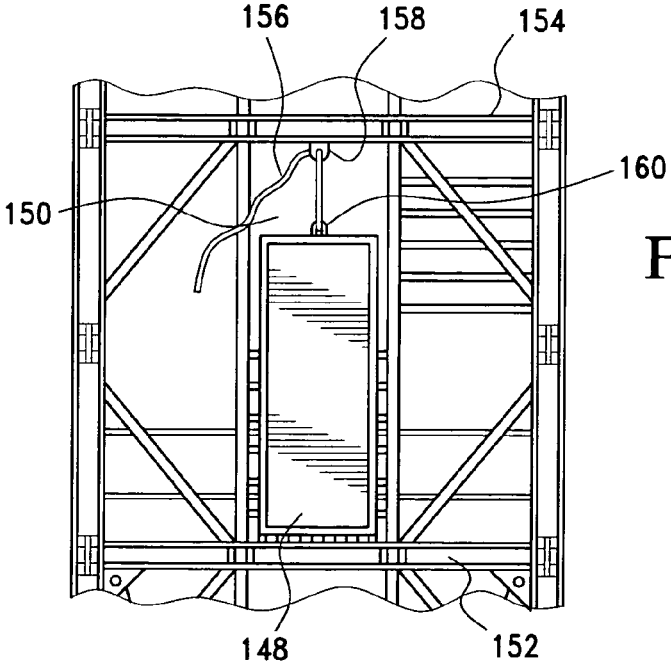
FIG. 16
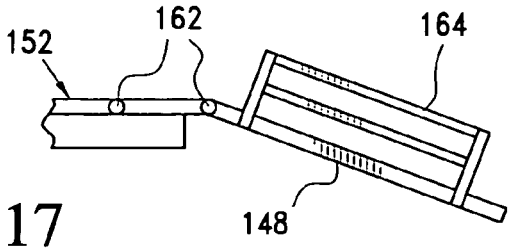
FIG. 17

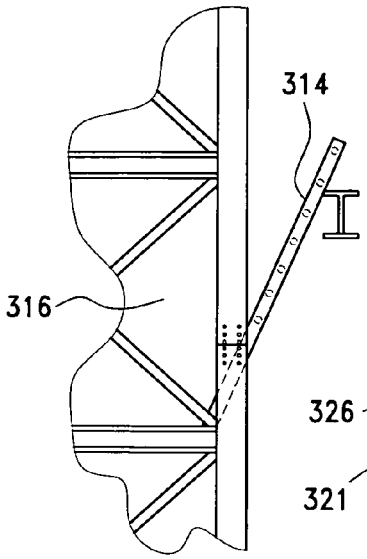
FIG. 27
FIG. 28
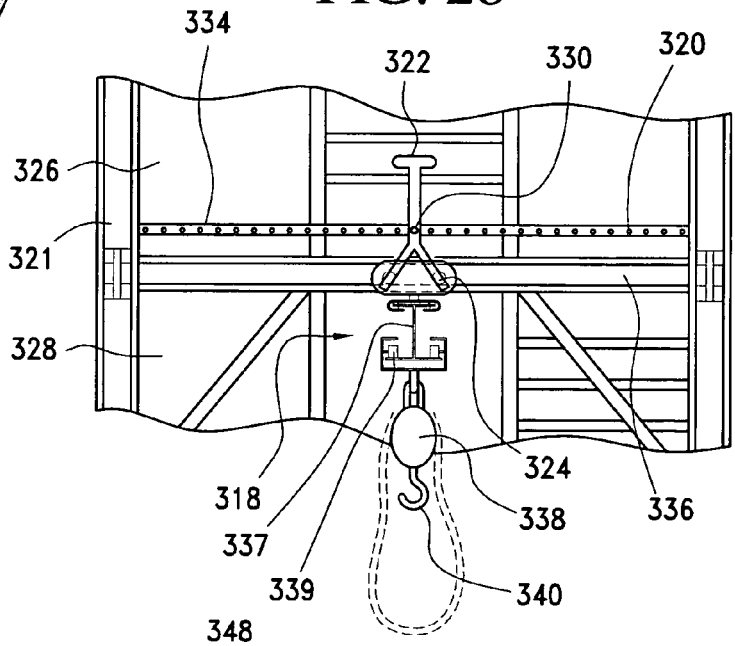
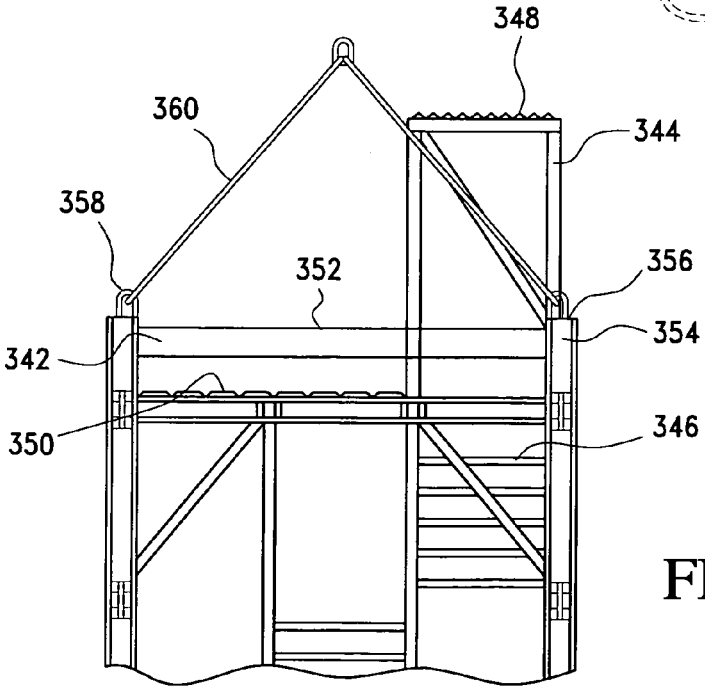
FIG. 29

MODULAR MULTILEVEL ACCESS PLATFORM AND METHOD FOR ERECTING THE SAME

BACKGROUND

Conventional ladders and scaffolding for use in building construction have many inherent problems, the most prominent thereof being that they are a major source of injuries among construction workers. Injuries may occur from the slightest of worker tasks such as transportation of small tools, material and food between levels of building construction. Workers commonly suffer injuries such as back strain, ankle strain, and bruises when ascending and descending ladders, or transporting items via pulleys and other conveying devices. In addition, there is seldom any protection from and for falling debris, and workers are therefore exposed to risk of injury from such debris. Moreover, ladders do not restrain a worker in the event of a fall, and known scaffolding has limitations in also restraining fallen workers.

A drawback to scaffolding is that it may be labor intensive to erect, and may not provide sufficient coordination to meet height requirements of a high rise building. The limitations of erecting ladders in building construction are self-apparent in that they are limited in height and must be stabilized. Providing additional levels or moving the scaffolding at or to different building constructions may prove cumbersome and time consuming, and moreover the scaffolding may not possess sufficient structural strength and stability to execute certain construction operations or support construction tools and many workers.

Productivity losses are inherent in building construction using ladders and scaffolding. Losses may occur due to the time and effort required to transport goods between building levels. Moreover, due to the lack of stability and nature of ladders, workers must ascend and descend levels of the building construction with the utmost care. Typically, ladders are used in scaffolding and thus the drawbacks of ladders are also present in most known scaffolding systems. Productivity losses also occur due to poor organization of utility access between levels, such as in receiving supplies of electricity, compressed air, oxygen, gas and water. Such utility access is rarely centralized and is instead scattered at numerous and random locations.

For the foregoing reasons, there is need for an access platform that overcomes the attendant drawbacks and disadvantages of known ladders and scaffolding systems in providing a safe, productivity increasing, easily erectable, portable and installable access platform assembly.

SUMMARY

The present invention is directed to a multilevel access platform that satisfies the needs of providing a safe, productivity increasing, and easily erectable and installable access platform assembly. In an embodiment of the multilevel access platform, the platform includes a plurality of platform modules wherein each includes elongated column members that are generally parallel and coextensive, and at least two levels of elongated lateral members that extend transversely between and are connected to the column members. Each platform module also includes platform sections that are supported by the lateral members, and a staircase that can extend between each level of the lateral members. The levels of the lateral members are located at vertically spaced positions relative to the column members and each of the lateral members borders a side of the module.

In another embodiment of the staircase, the staircase extends between each level of lateral members and includes first and second stair segments disposed adjacently in parallel vertical planes. The first stair segment connects to a first level of lateral members and extends about halfway between the first level of lateral members and a second level of lateral members in a first direction. The first stair segment connects to the second stair segment and extends in a second direction towards the second level of lateral members. The stair segments are modular and are stabilized to the multilevel platform.

In yet another embodiment of the platform module, at least one portal is located between adjacent levels of the lateral members. The portal is defined by mutually opposed web members that comprise a first leg that extends between opposed levels of lateral members, and second and third legs that are inclined to the first leg and extending diagonally from adjacent ends of the first leg to one of the column members. Numerous features may be provided which cooperate and extend from the portals, including ramps and ladders.

In yet another embodiment of the multilevel platform, outriggers are provided which are pivotally connected to the lateral members. The outriggers have a deployed position defined as extending outwardly from and generally parallel with a corresponding level of the lateral members, and a stowed position defined as extending generally parallel with the column members. In other embodiments, the outriggers may be vertically offset relative to the lateral members.

In yet another embodiment of the multilevel platform, a platform base assembly is provided which can connect to a base portion of one of the stackable modules. The base assembly includes a housing supporting a plurality of support beams that are each extensible relative to the housing and have an anchor device at a first end thereof arranged to extend outwardly from the housing. The anchor device of each support beam is provided to secure and independently stabilize the platform at a work site.

In yet another embodiment of the multilevel platform, access to utilities is provided along each of the platform modules and thus on each level. Moreover, appropriate trolleys and pulleys may be provided on or above each level wherein access is provided directly below.

BRIEF DESCRIPTION OF THE DRAWINGS

These and other features, aspects, and advantages of the present invention will become better understood with regard to the following description, appended claims, and accompanying drawings where:

FIG. 15 is a frontal elevational view showing another embodiment of an outrigger assembly;

FIG. 16 is a frontal elevational view showing an embodiment of a ramp;

FIG. 17 is a side elevational view showing the ramp of FIG. 15;

FIG. 27 is an elevational sectional view showing an embodiment of a ladder connected to a level of the inventive platform;

FIG. 28 is an elevational sectional view showing an embodiment of a trolley connected between two levels of the inventive platform;

FIG. 29 is an elevational sectional view showing an embodiment of a top level of the inventive platform.

DETAILED DESCRIPTION OF VARIOUS EMBODIMENTS

A. Overview

Figure 1:
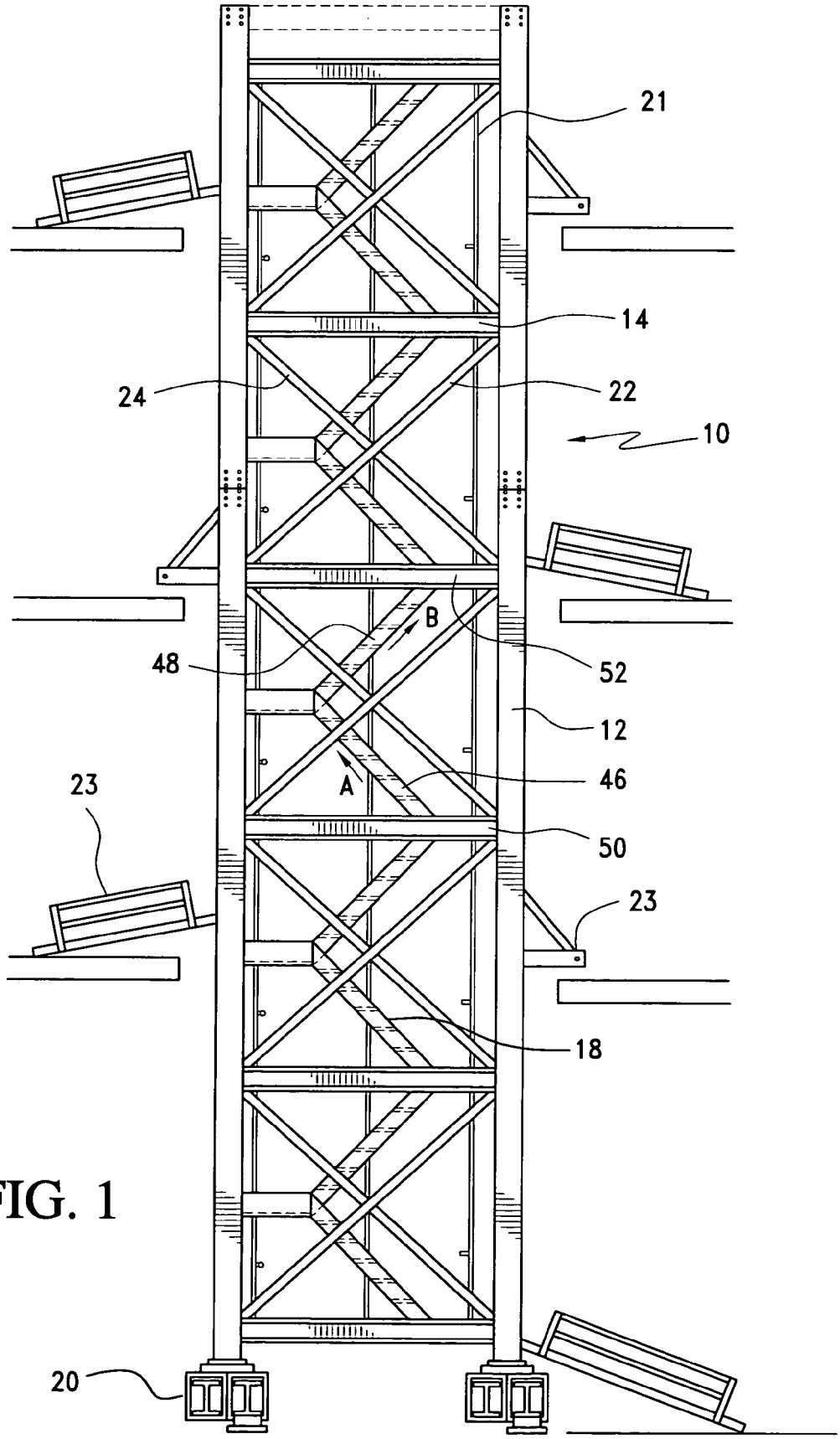
FIG. 1 is an elevational view of one side of a multilevel access platform embodying features of the inventive platform.

A better understanding of different embodiments of the invention may be had from the following description read in conjunction with the accompanying drawings in which like reference characters refer to like elements.

While the disclosure is susceptible to various modifications and alternative constructions, certain illustrative embodiments thereof are shown in the drawings and will be described below in detail. It should be understood, however, that there is no intention to limit the disclosure to the specific embodiments disclosed, but on the contrary, the intention is to cover all modifications, alternative constructions, combinations, and equivalents falling within the spirit and scope of the disclosure and defined by the appended claims.

It will be understood that, unless a term is expressly defined in this patent to possess a described meaning, there is no intent to limit the meaning of such term, either expressly or indirectly, beyond its plain or ordinary meaning.

Any element in a claim that does not explicitly state "means for" performing a specified function, or "step for" performing a specific function, is not to be interpreted as a "means" or "step" clause as specified in 35 U.S.C. § 112, paragraph 6.

B. Environment and Context of Embodiments

Embodiments of the invention are discussed in the context of a portable, multilevel access platform that may be used for in the erection of a building construction having a plurality of superimposed floor levels. The multilevel access platform may be inserted into a building shaft prior to completion of such building, and may be subsequently disassembled or withdrawn from the building when usage thereof is deemed complete. The multilevel access platform may be installed in the building shaft fully assembled, or may be erected outside or in the shaft.

The environment and context of the embodiments of the invention are also with respect to use of the multilevel platform for a construction site or similar setting. The multilevel platform may therefore be adapted to the range of environmental conditions that may exist at any construction location, and configured for withstanding the normal activities associated with building construction.

It is to be understood that other analogous uses of the multilevel platform according to the nature of the embodiments described herein are possible. It is also to be understood that other uses for supporting structures are possible with and without the base assembly to be discussed below.

C. Various Embodiments of the Multilevel Access Platform

Figure 2:
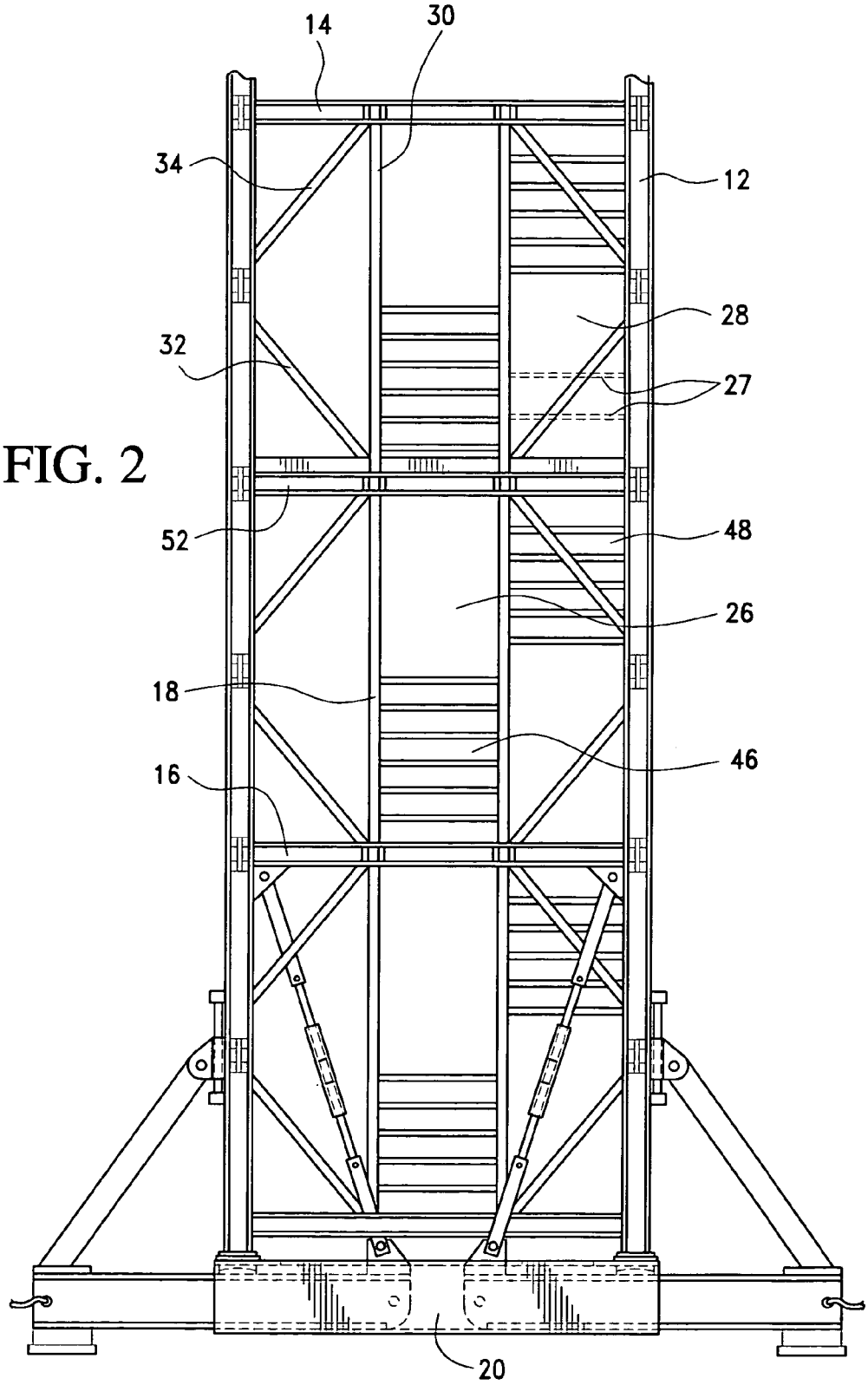
FIG. 2 is an elevational view of another side of the multilevel access platform according to FIG. 1.

FIGS. 1 and 2 illustrate an embodiment of a multilevel access platform 10 according to the invention. The multilevel platform 10 includes elongated column members 12 that are generally parallel and coextensive, and levels of elongated lateral members 14 extending transversely between and connected to the column members 12. Each level of the multilevel platform 10 is located at a vertically spaced position along the column members 12. Each of the lateral members 14 borders a side of the platform 10, and a plurality of platform sections 16 are supported by the lateral members 14 at corresponding levels. A staircase 18 extends between each level of the lateral members 14 and connects each of the levels. A base assembly 20 is connected to a lower end (or base) of the column members 12 and is arranged for supporting the multilevel platform 10.

Suitable utility access conduits 21 may be provided for each level of the platform 10, such utility access conduits 21 including means for electricity, gas, oxygen, and compressed air. Welding machine generators can similarly be attached or placed on levels of the platform, and appropriate lighting may be provided above each platform level and staircase 18.

Loading devices 23 such as ramps and pulleys may be pivotally connected to platform levels to facilitate access to and from the platform 10. Moreover, safety devices 25, such as extending outriggers pivotally connected to the platform, may be provided for each platform level.

As shown in FIG. 1, two diagonal members 22, 24 extend between and are connected to two sets of adjacent lateral members 14 on opposed sides of the multilevel platform 10. Conversely, FIG. 2 shows portals 26 defined between the levels of the lateral members 14 which are located on sides of the platform 10 in this embodiment which are adjacent to the sides having the diagonal members 22, 24.

Each portal 26 is defined by mutually opposed web members 28. Each web member 28 includes a first leg 30 extending between opposed levels of lateral members 14 and generally parallel with the column members 12. The web member also includes second and third legs 32, 34 which are inclined in orientation to the first leg 30 and extend diagonally from adjacent ends of the first leg 30 to one of the column members 12.

The portals 26 provide access to levels of the platform and generally correspond to floors of the building construction, while the diagonal members 22, 24 and the web members 28 provide support to the platform by reinforcing its structure and moreover, prevent access to the platform at adjacent regions thereof. It will be understood that it is considered to be clearly within the scope of the invention to provide portals of any height, width, or number.

Figure 3:
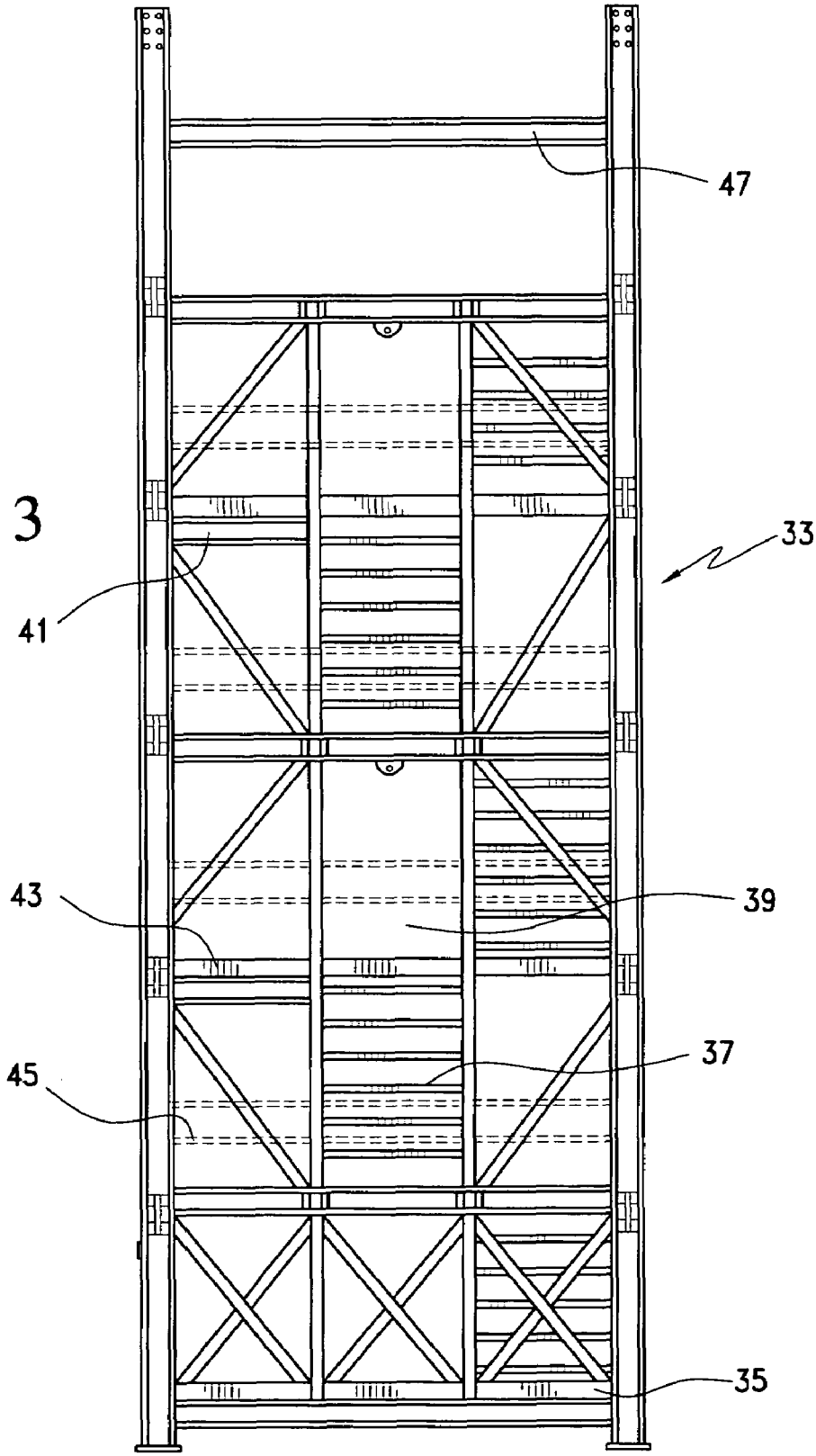
FIG. 3 is an elevational view of an embodiment of a structural configuration of a multilevel access platform.

Turning to FIG. 3, an embodiment of a half-tier platform assembly 33 is shown, wherein the assembly 33 has access to half-tier portions thereof. For example, the assembly 33 includes half-tier level 35 and full tier levels 39 with staircase 37 extending therebetween. Platform beams 41 with an appropriate toe-kick 43 are provided between each platform level 39. Appropriate safety cables 45, as is consonant with embodiments of the invention, may be provided at each half-tier of the assembly 33. A spacer beam 47 may be provided to reinforce the assembly 33 or to provide a means for transporting the assembly 33.

Figure 4:
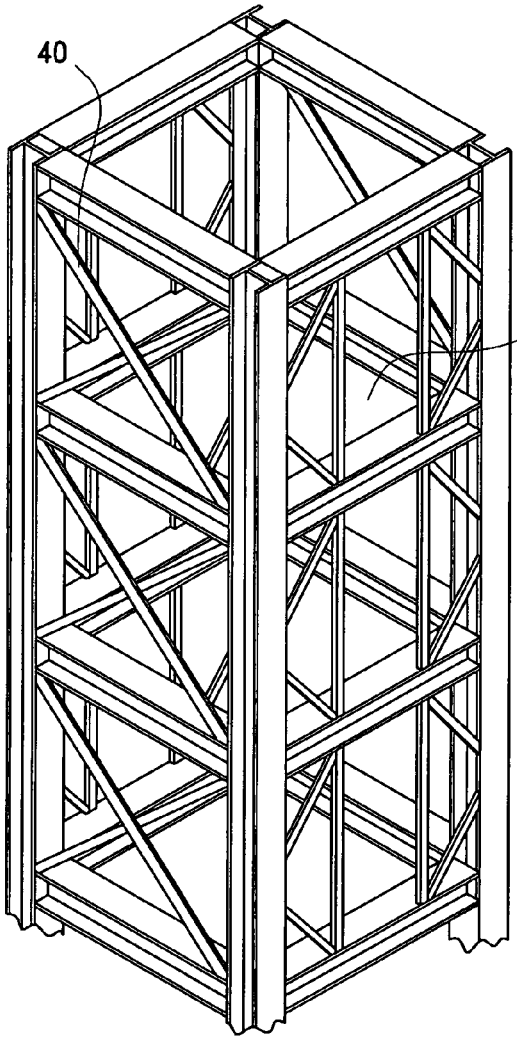
FIG. 4 is perspective view of another embodiment of a structural configuration of a multilevel access platform.
Figure 5:
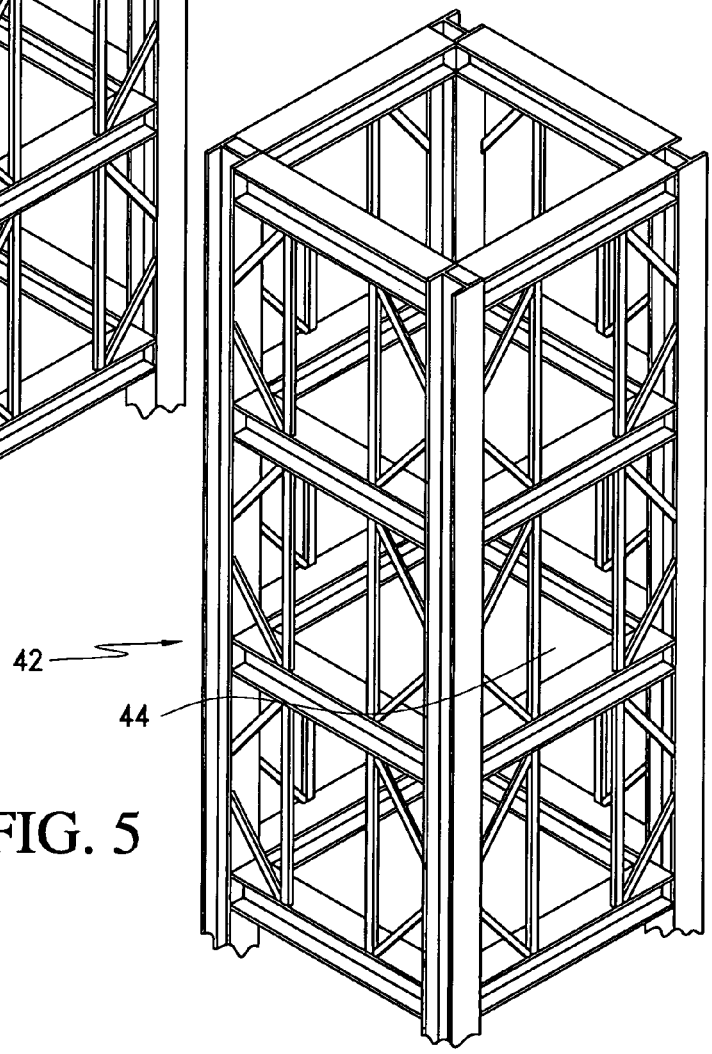
FIG. 5 is a perspective view of another embodiment of a structural configuration of a multilevel access platform.

As shown in FIGS. 4 and 5, portions of a basic structure of the platform may be arranged with different portal locations. For example, in the embodiment illustrated in FIG. 4 and similar to the embodiment shown in FIGS. 1 and 2, a basic platform structure 36 defines portals 38 on opposed sides, whereas sides adjacent the portals are reinforced with diagonal structural members 40. On the other hand, FIG. 5 shows a basic platform structure defining a portal 44 on each side thereof. Of course, it will be understood that it is within the scope of the invention to define portals on only one side of a basic platform structure, or in the alternative, levels having different numbers of portals.

Returning to the embodiment shown in FIGS. 1 and 2, the staircase 18 is configured to extend between each level of the lateral members 14. Between each level of the lateral members 14, the staircase 18 includes first and second stair segments 46, 48 of generally identical construction and disposed adjacently in generally parallel vertical planes. The first stair segment 46 connects to a lower (or first) level of lateral members 50 and extends about halfway between the lower level of lateral members 50 and an upper (or second) level of lateral members 52 in a first inclined direction A. The first and second stair segments 46, 48 join halfway between the upper and lower levels 50, 52 of lateral members to define an intermediate landing 54. The second stair segment 48 extends from the first stair segment 46 in a second inclined direction B towards the second level 52 of lateral members.

Figure 7:
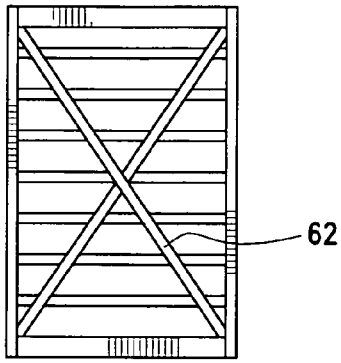
FIG. 7 is a bottom plan view of the stair segment in FIG. 6.
Figure 6:
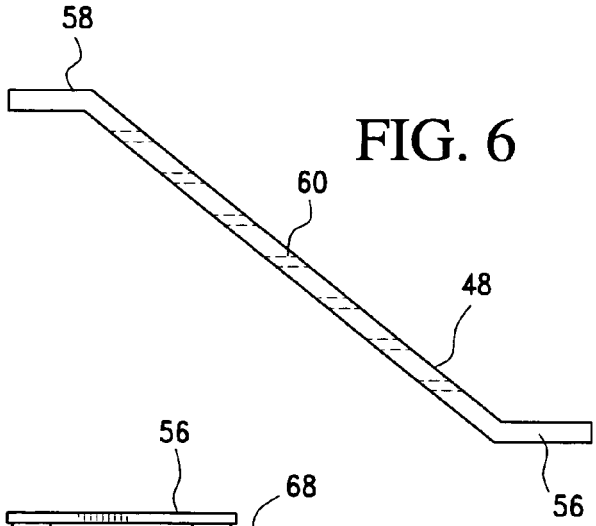
FIG. 6 is an elevational view showing an embodiment of a stair segment of the platform of FIG. 1.
Figure 8:
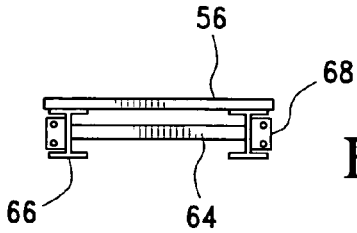
FIG. 8 is an elevational, schematic view showing the stair segment of FIG. 6 mounted on the platform of FIG. 1.

In FIGS. 6-8 an exemplary construction of the staircase 18 is shown. FIG. 6 shows the basic construction of stair segment 46, whereby stair segment 46 is interchangeable with stair segment 48 shown in FIGS. 1 and 2. Stair segment 46 includes first and second landing portions 56, 58 defined at end portions thereof, and defines a plurality of steps 60. FIG. 7 illustrates an embodiment of the stair segment 48 being reinforced with support members 62 that are positioned underneath stair segment 48.

FIG. 8 illustrates the first landing portion 56 as being secured to the platform by an angle brace 64 that extends underneath thereof and spans opposed support members 66. The angle brace 64 is to the support members 66 connected therewith by suitable fasteners 68. The support members 66 may be I-beams or other suitable structural members provided for retaining the staircase under normal operating conditions which would be understandable to a skilled artisan. Similarly, the angle brace 64 may be selected from a variety of materials and configurations sufficient to reinforce the connection of the staircase to the platform.

Figure 9:
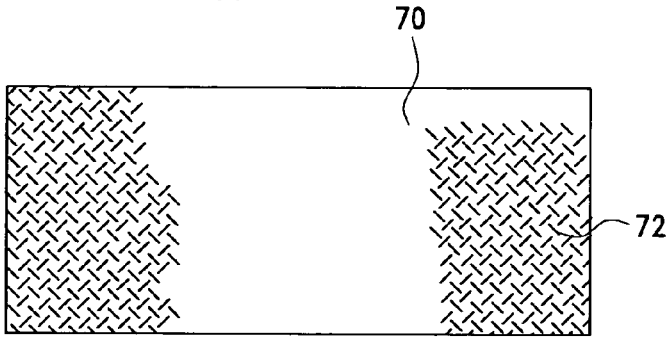
FIG. 9 is an elevational view showing an embodiment of a platform section in the platform of FIG. 1.
Figure 10:
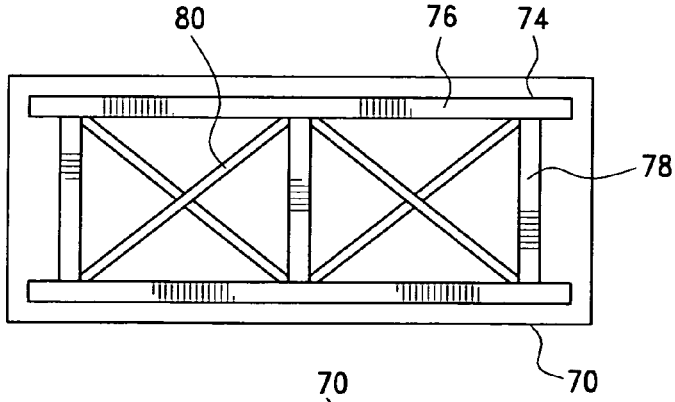
FIG. 10 is a bottom plan view of the platform section in FIG. 6.
Figure 11:
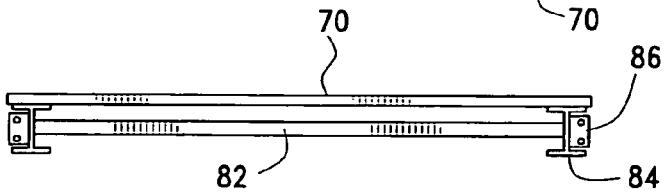
FIG. 11 is a schematic elevational view showing the platform section of FIG. 9 mounted on the platform of FIG. 1.

FIGS. 9-11 illustrate an embodiment of the aforementioned platform sections 16 described herein in connection to FIGS. 1 and 2. More specifically, the platform section 70 shown in FIG. 9 comprises a generally flat and rectilinear plate. The platform section 70 has a textured or perforated surface 72 that may be constructed of expanded metal, perforated metal, bar grating, fiberglass grating, hex metal and other suitable platform or decking materials or configurations.

In FIG. 10, an embodiment of a reinforcement structure 74 for each platform section 70 is shown. The reinforcement structure 74 is generally intended to be positioned underneath the platform section 70 and includes a plurality of longitudinal members 76 connected to a series of transverse members 78. A plurality of reinforcing diagonal members 80 span distances between the longitudinal members 76 and transverse members 78, and serve to improve the structural integrity of the reinforcement structure 74.

Similar to the configuration discussed above in connection with FIG. 8 regarding securing the stair segments to the platform, FIG. 11 illustrates that the platform section 70 may be secured to the platform by an angle brace 82 that extends underneath thereof and spans opposed support members 84. The angle brace 82 is connected to the support members 84 by suitable fasteners 86. The support members 84 may be I-beams or other suitable structural members provided for retaining and securing the platform section against the platform understandable to a skilled artisan. Similarly, the angle brace 82 may be selected from a variety of materials and configurations sufficient to reinforce the connection of the platform section to the platform.

Figures 12, 13, 14:
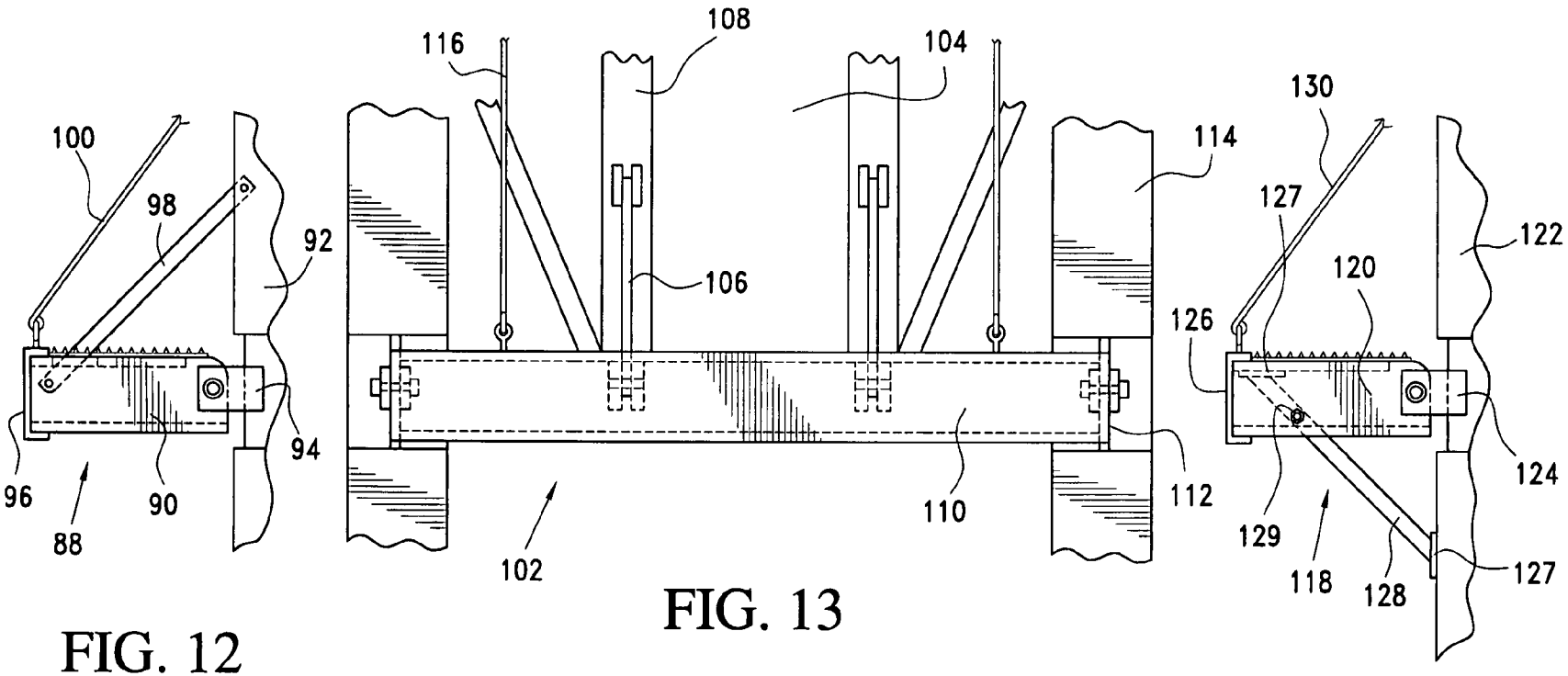
FIG. 12 is an side elevational view showing an embodiment of an outrigger assembly.
FIG. 13 is a frontal elevational view showing another embodiment of an outrigger assembly.
FIG. 14 is a side elevational view showing another embodiment of an outrigger assembly.

FIGS. 12-15 illustrate embodiments of foldable outriggers that may be installed on the platform. In FIG. 12, an embodiment of an outrigger 88 includes a center beam 90 pivotally connected to a column 92 of the platform by a pivot device or plate 94 located at a first end of the outrigger 88. A channel element 96 is positioned about a second end of the center beam 90 at a second end opposed from the first end of the outrigger 88. Struts 98 are pivotally connected to the second end of the outrigger 88 and the column 92, and are provided to retain and support the outrigger 88. In this embodiment, the struts 98 are positioned vertically above the center beam 90. Support cables 100 are joined to the second end of the outrigger 88 and connect to the column 92.

FIG. 13 shows an embodiment of an outrigger 102 adapted for use along a side of the platform having a portal 104. The outrigger 102 includes first struts 106 that are detachably mounted onto a web member 108 bordering the portal 104. The first struts 106 are pivotally connected to a channel element 110 of the outrigger 102 that in turn is pivotally connected to second struts 112 which are pivotally connected to column 114. The second struts 112 are detachably mounted to the column 114, and permit removal of the channel 110 from the inventive platform to accommodate a ramp. Support cables 116 are joined to the outrigger 102 and connect to the column 114. This particular outrigger embodiment may be configured to block access to the portal 104 by raising the outrigger towards the portal as shown in FIG. 13, or opened to permit free passage through the portal.

FIG. 14 exemplifies another embodiment of an outrigger that may be used in the inventive platform. More specifically, outrigger 118 includes a center beam 120 pivotally connected to a column 122 by a pivot device or plate 124 located at a first end of the outrigger 118. A channel element 126 is positioned about a second end of the center beam 120 at a second end opposed from the first end of the outrigger 120. Struts 128 are pivotally connected to the second end of the outrigger 120 and the column 122, and are provided to retain and support the outrigger 88. In this embodiment, the struts 128 are positioned vertically below the center beam 120. Support cables 130 are joined to the second end of the outrigger 120 and connect to the column 122. Appropriate plates or brackets 127 may be used to mount struts 128 to the column 122 and the channel element 126.

FIG. 15 shows an embodiment of an outrigger 132 extending along a side of the platform without a portal. In this embodiment, the outrigger 132 includes struts 138 pivotally connected to the column 140 and extending upwardly therefrom to secure onto a center beam 134. The outrigger 132 has a channel element 136 secured along a face of the center beam 134. A safety structure 142 is provided which couples to diagonal members 144 of the platform and thereby secures entry to and from the side of the platform having the outrigger 132. Cables or other appropriate elements 146 provide support to the outrigger 132, and are connected to the inventive platform and the outrigger 132.

In each of the embodiments discussed herein, a top surface of the outriggers may include or be constructed from expanded metal, perforated metal, bar grating, fiberglass grating, hex metal and other suitable decking materials. It is important that the outriggers prevent objects from falling beyond each respective level of the platform and it will be understood that the platform is not limited to the embodiments of the outriggers described herein. It is thus envisioned that the platform may comprise any outrigger safety device known to a skilled artisan for preventing falling objects from a level of the platform.

FIGS. 16 and 17 show an embodiment of a pivotable ramp 148 that may be provided along the sides of each level of the lateral members 14 of the inventive platform. As shown in FIG. 16, the ramp 148 blocks the portal 150 when the ramp is in a retracted or stowed position. The ramp 148 is pivotally connected to a lateral member 152 of a first level. A tow element 156, such as a rope or cord, extends around a pulley 158 connected to a lateral member 154 of a second level and connects to a hitch device 160 connected to the ramp 148. While the pivotable ramp of this embodiment is shown in cooperation with lateral members of a portal and thus a platform section, the ramp may also be pivotally mounted along the sides of the platform corresponding to the portals and leading to and from the intermediate landing.

FIG. 17 illustrates the ramp 148 in a deployed position. As shown, the ramp 148 extends from the lateral member 152 and pivots at hinge or points 162. The arrangement of the pivot points 162 permits storage of the ramp 148 within the platform level in which the lateral member 152 corresponds. The ramp 148 may include a guardrail system 164 provided to prevent workers and construction items such as tools from falling off the ramp to floor levels. The guardrail system may be comprised of midrails, mesh, intermediate vertical members, solid panels, and equivalent structural members. Similar to the outriggers, the ramp may be constructed from expanded metal, perforated metal, bar grating, fiberglass grating, hex metal, wood planks, and other suitable decking materials sufficient to withstand repeated loads.

Figure 18:
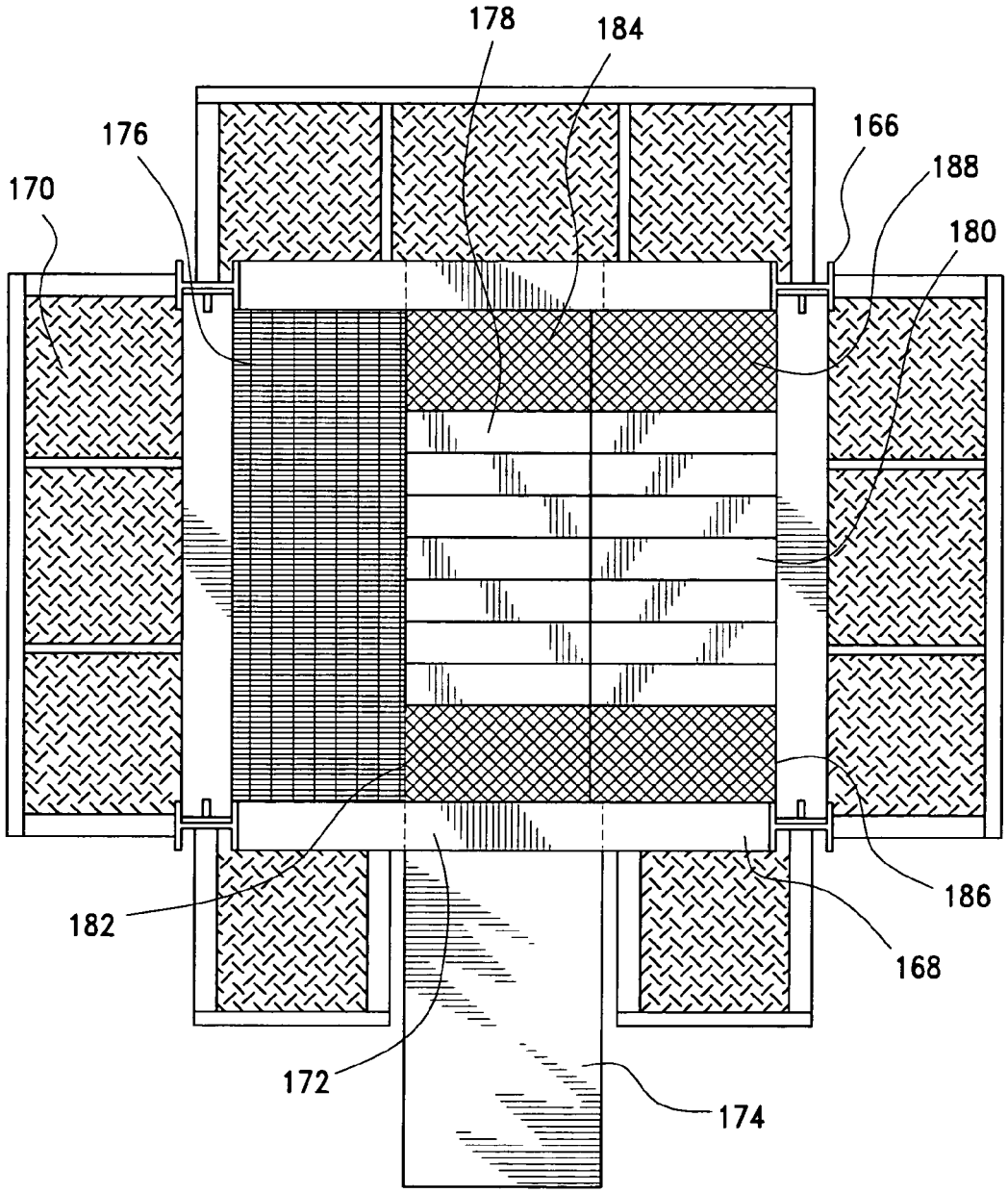
FIG. 18 is a schematic plan view showing an embodiment of a platform level of the platform of FIG. 1.

As exemplified in FIG. 18, an embodiment showing a level of the inventive platform is shown with embodiments and configurations of outriggers, a ramp, and a staircase. In this exemplary embodiment, column members 166 and lateral members 168 border the level and establish the periphery thereof. A plurality of outriggers 170 extend beyond the lateral members 168 with the exception of the region of the lateral members 168 defined by the portal 172. Extending from the portal 172 is a ramp 174 in a deployed position. The level includes a platform section 176 that is generally parallel to first and second stair segments 178, 180.

The first stair segment 178 includes first and second landing portions 182, 184. The first landing portion 182 of the first stair segment is shown as being generally parallel with the platform section 176 and contiguous therewith. The second landing portion 184 of the first stair segment 178 is juxtaposed to the second landing portion 188 of the second stair segment 180 to define a generally contiguous landing, as discussed more fully above. The first landing portion 186 extends to the next vertically succeeding level above the level shown in FIG. 18.

Figure 19:
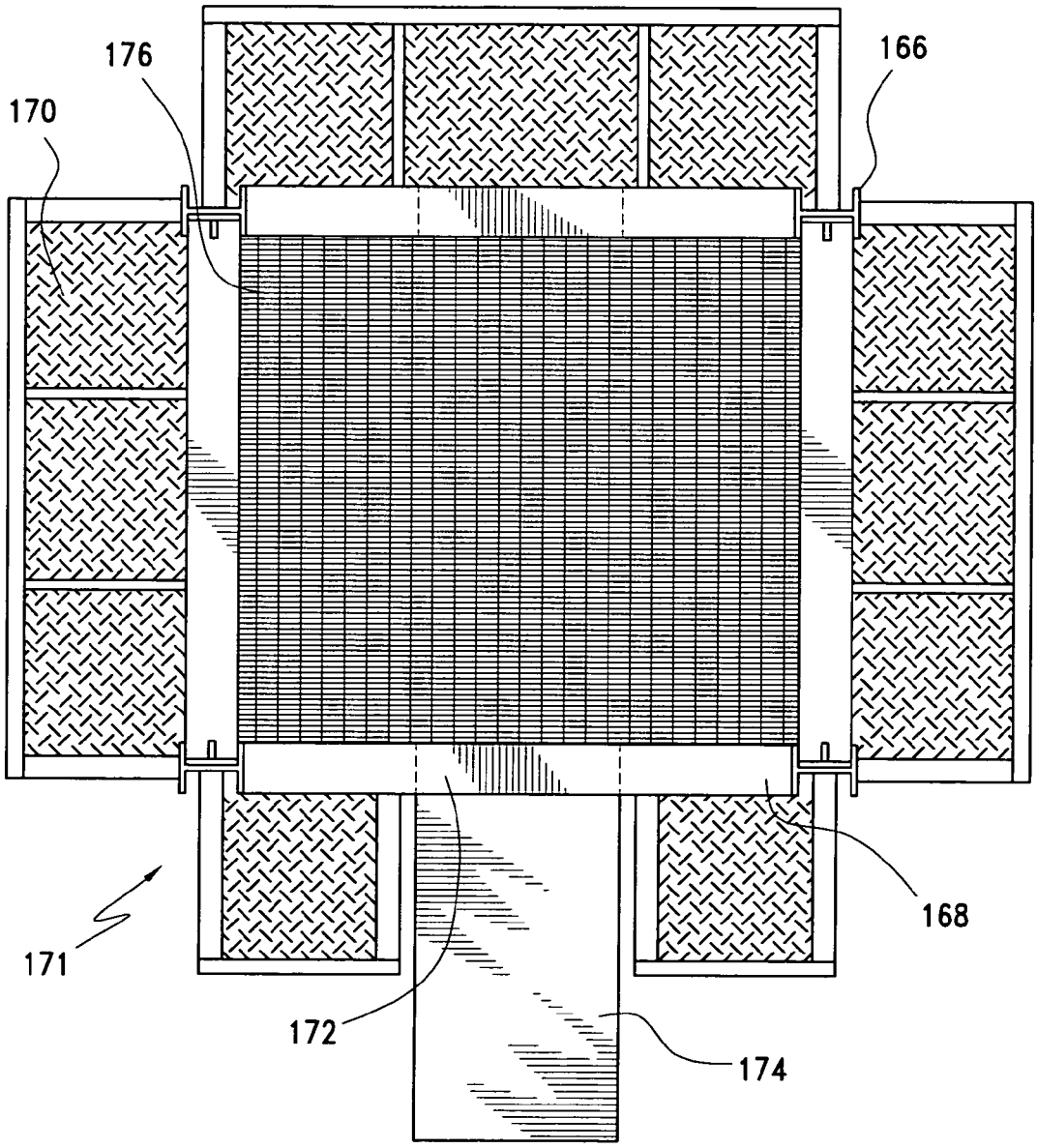
FIG. 19 is another schematic plan view showing an embodiment of a base platform level of the platform of FIG. 1.

FIG. 19 is similar to FIG. 18 except that platform level 171 lacks a staircase. This level 171 is preferably used as the base level of a platform according to the invention.

It will be understood that the outriggers are not limited to being installed on the platform so as to be substantially parallel with the platform or lateral members of each level. Alternatively, the outriggers may be positioned and vertically spaced along the column members at any location thereof.

As briefly discussed above, the inventive platform includes a base assembly for securing and supporting the inventive platform structural members. An embodiment of a base assembly 190 is shown in detail in FIG. 20. In this embodiment, the base assembly 190 is secured to a base portion of column members 192. The base assembly 190 includes a housing 194 that supports a plurality of support beams 196 that are extensible relative to the housing 194. The support beams 196 are slidably supported on track elements 222 disposed within the housing 194.

Each support beam 196 defines first and second ends 198, 200. The first end 198 of each support beam 196 connects to an anchor device 202 that generally extends perpendicularly from the support beam 196. The second end 200 of each support beam 196 connects to a first end 206 of a turnbuckle 204 or similar device. Each turnbuckle 204, in turn, has a second end 208 that is pivotally connected to a corner member 212 defined between lateral members 210 extending above the base assembly 190 and column members 192 bordering the base assembly 190. The base assembly 190 also includes a plurality of sliding support legs 214 that are each secured at a first end 216 thereof to the first end 198 of each support beam 196, and are slidably connected at a second end 218 thereof to one of the column members 192 by a slider device 220.

Figure 20:
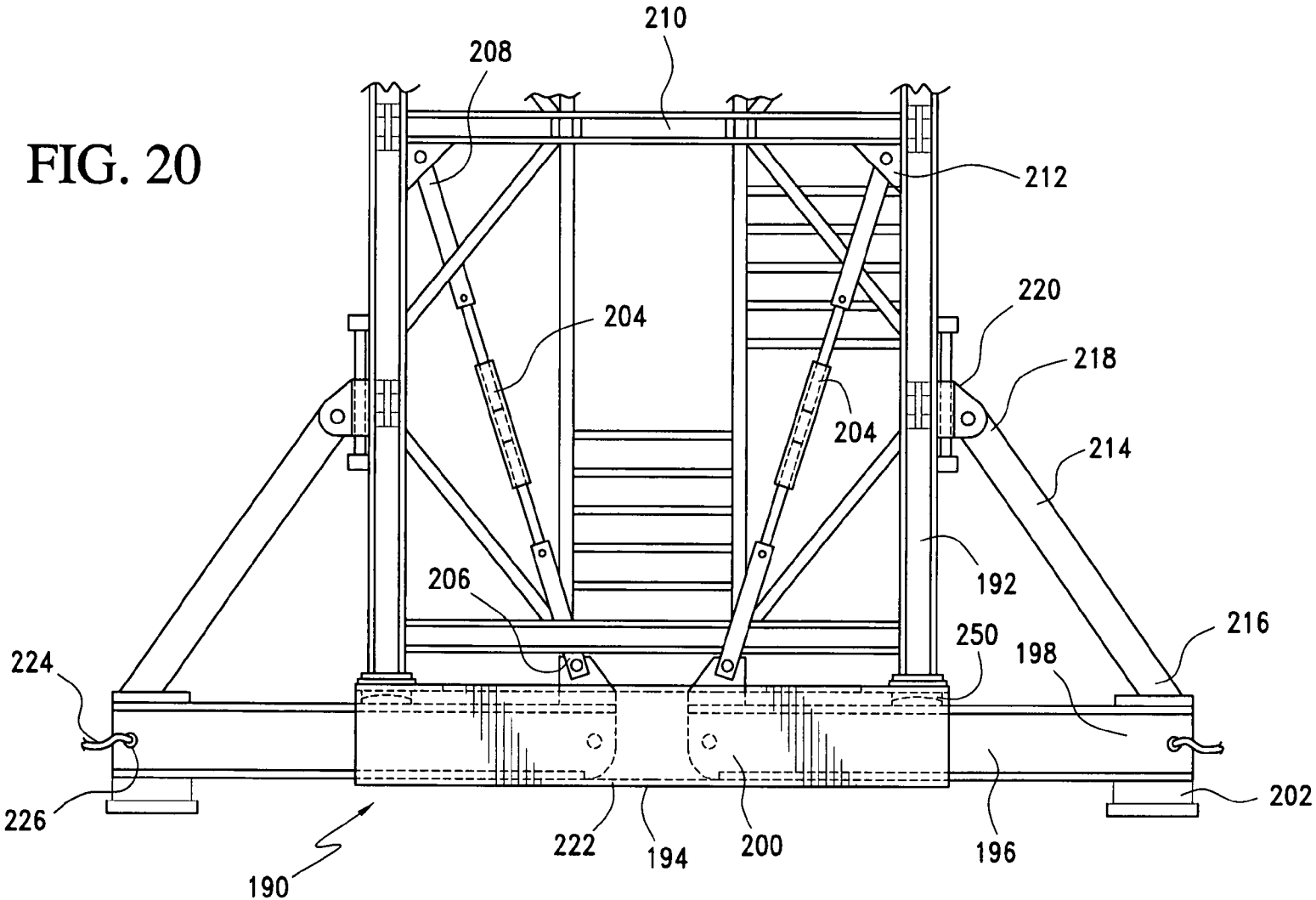
FIG. 20 is detailed frontal elevational view of a base assembly shown in FIG. 2.

A suitable tow element or elements 224 may be provided to assist in deployment of the support beams 196 outwardly from the housing 194 or to stow the support beam inwardly into the housing 194. In the embodiment shown in FIG. 20, the tow elements 224 comprises rope segments connected to eyelets 226 formed at the first end 198 of the support beams 196. It will be noted that the support beams 196 in FIG. 20 are shown in a deployed position defined by the outwardly extension of the support beams 196 relative to the housing 196. Eyelets 226 are also formed on the second end 200 of the support beams 196. It will be understood that tow elements can be secured to eyelets 226 for positioning the support beams 194 within the housing 194, as will be shown in FIG. 21. Of course, the tow elements and eyelets may be modified or replaced with alternative tow elements and connectors known to a skilled artisan.

Figure 21:
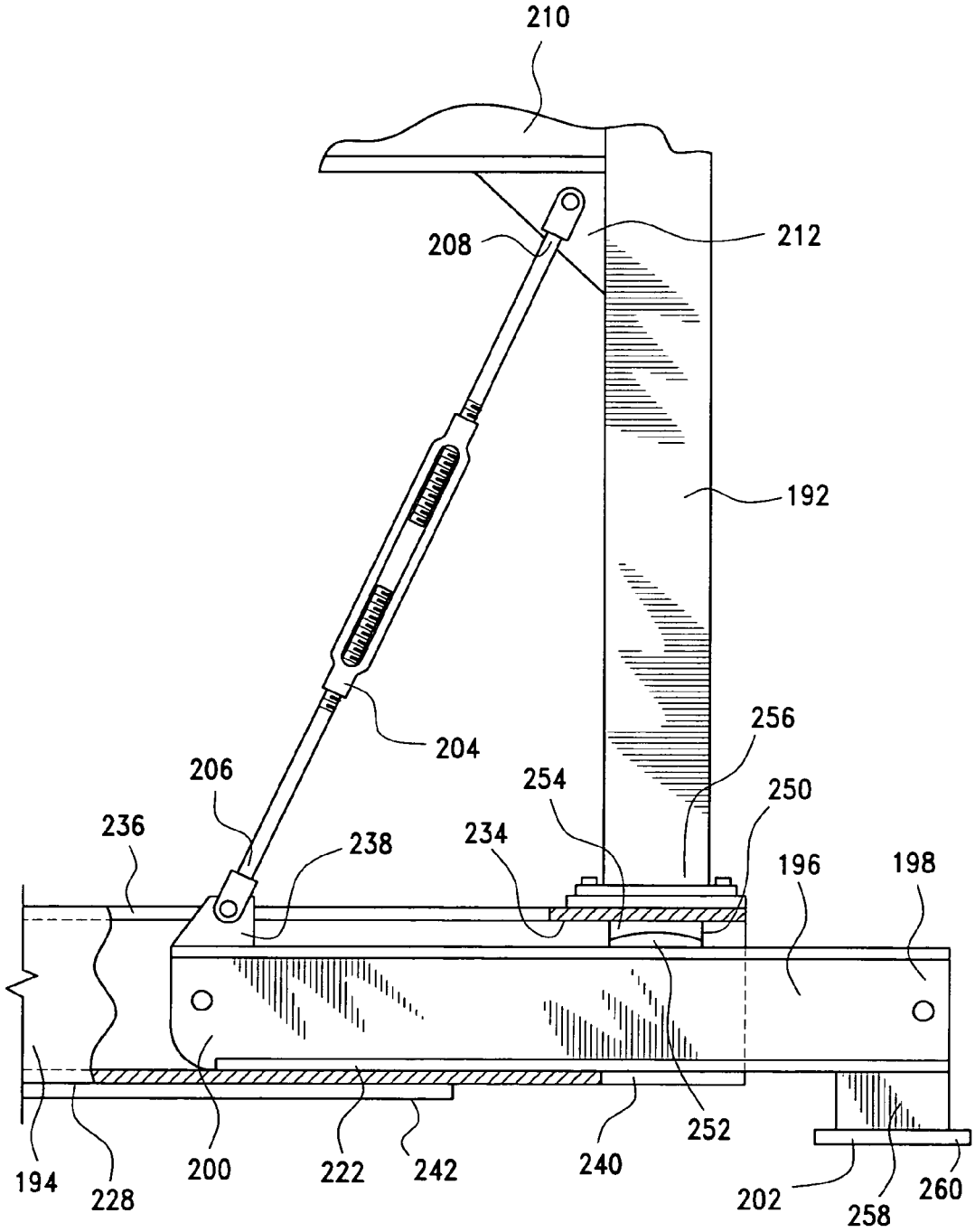
FIG. 21 is a sectional elevational view of an embodiment of a base assembly.
Figure 22:
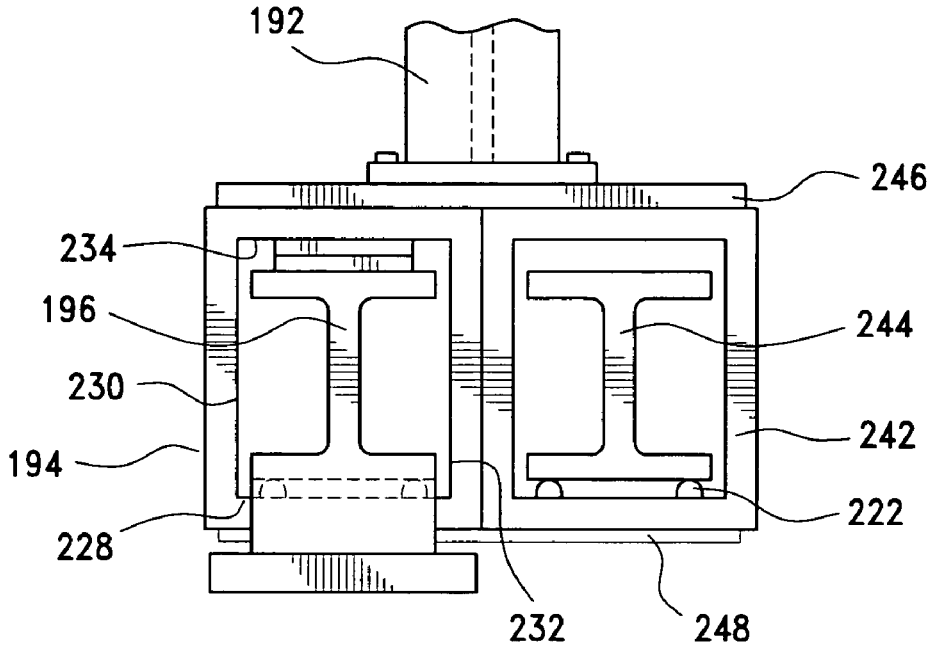
FIG. 22 is a sectional side elevational view of a portion of the base assembly shown in FIG. 20.

In reference to FIGS. 21 and 22, the housing 194 comprises a box beam-like structure having a bottom surface 228 upon which track elements 222 are supported, opposed side portions 230, 232, and a top surface 234 opposed to the bottom surface 228. According to this embodiment, the top surface 234 defines a longitudinally extending passageway 236. Mounted near or at the second end 200 of the support beam 196 is a mount 238 secured thereon. The first end 206 of the turnbuckle 204 is pivotally joined to the mount 238, thereby connecting the turnbuckle 204 between the support beam 196, and the column members 192 and the lateral members 210. The passageway 236 is configured to permit the mount 238 to extend at least partially therethrough as the support beam 196 slides within the housing 194.

While shown schematically in FIG. 20 as being connected to the support beams 196, the turnbuckles 204 are preferably only mounted to the support beams 196 when the support beams 196 are fully extended from the housing 194.

It will be noted that the bottom surface 228 of the housing 192 corresponding to the first end 198 of the support beam 196 may have a recessed portion 240 to accommodate the support beam 196 therewithin so as to permit the anchor device 202 to be stored within the confines of the housing 194.

FIGS. 21 and 22 both show an embodiment of the configuration of adjacent housings 194, 242. In this embodiment, the housings 194, 242 extend parallel and adjacent to one another under the column member 192. The support beams 196, 244 contained within the housings 194, 242 are arranged to extend in different directions, as exemplified by the anchor device 202 on support beam 196. The housings 194, 242 may be joined together by first and second reinforcing plates 246, 248.

As illustrated in FIG. 21, the base assembly 190 includes a pivot plate assembly 250 corresponding to each support beam 196, and comprises first and second plates 252, 254. The first plate 252 is mounted on the support beam 196 and has a convex profile, and the second plate 254 is mounted on base end 256 of the column members 254 and has a concave profile complementary to the convex profile of the first plate 252. The first and second plates 252, 254 are positioned and configured so that upon outwardly extension of the support beam 196 from the housing 194, the first and second plates 252, 254 mate and thereby assist to prevent movement of the support beam 196. Moreover, due to their profiles, the first and second plates 252, 254 wedge against each other under the weight of the platform structural members thereabove.

When installing or removing the platform from a work site, it is intended that the support members 196 may be lifted from the track elements or lowered so that the first and second plates 252, 254 may be dislodged from one another.

It will be noted that the invention is not limited to the pivot plate assembly 250 shown above, and the scope of the invention is envisioned to cover all similar devices or assemblies that impart the benefits and advantages of the pivot plate assembly herein described.

In FIG. 21, the support beams 196 are shown in a stowed position within the housing 194 resting upon the track elements 222 mounted on the bottom 228 of the housing 194. The track elements 222 may be a pair of parallel and longitudinal beams substantially narrower in cross-section than the support beam 196 and project from the bottom 228 of the housing 194. It will be understood, however, that the track elements 222 may be modified such that in alternative embodiments the track elements and support beams comprise a plurality of track-like elements in combination with rollers or any other devices or structures that improve the sliding of the support beams 194 relative to the housing.

As briefly described above, the support beams 196 each include the anchor device 202 connected to the first end 198 thereof. In the embodiment shown herein, each anchor device 202 includes a vertical extension 258 mounted at the first end 198 of the support beam 202, and an anchor pad 260 mounted on the vertical extension 258 opposite the support beam 196. The vertical extension 258 may comprise any suitable structural configuration sufficient to extend and support the anchor pad 260, while withstanding the weight of the platform. The illustrated anchor pad 260 comprises a plate joined to the vertical extension 258. It will be noted that the anchor pad may comprise any suitable configuration or material that can sufficiently hold or support the platform in place. The vertical extension and the anchor pad may be detachably mounted to and from one another, and the vertical extension may be detachably mounted to the support beam.

Figure 23:
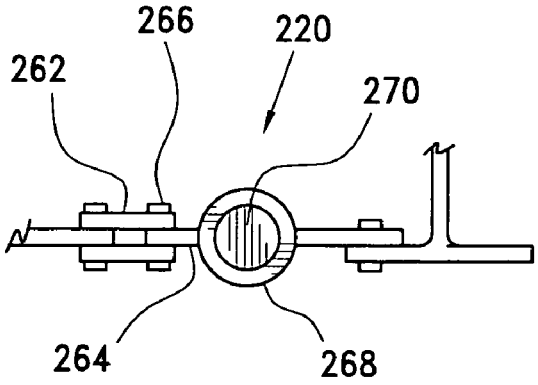
FIG. 23 is a top plan view of an embodiment of a slider device shown in FIG. 20.

FIGS. 20 and 23 illustrate an embodiment of the slider device 220. The slider device 220 includes a bridging element 262 connected to the second end 218 of the sliding leg 214. The bridging element 262 is pivotally connected to a spacer 264 and secured therewith with pins 266. The spacer 264, in turn, is connected to a slider sleeve 268 which encircles a slide pin or shaft 270 that extends from and is parallel with the column member 192. The slide pin 270 is secured to the column 192. In operation, the slider device 220 is coupled to the sliding leg 214 to permit the sliding leg 214 to adjust in movement according to the extension of the support beam 196, and moreover provides additional support to the extended support beams 196.

Figure 24:
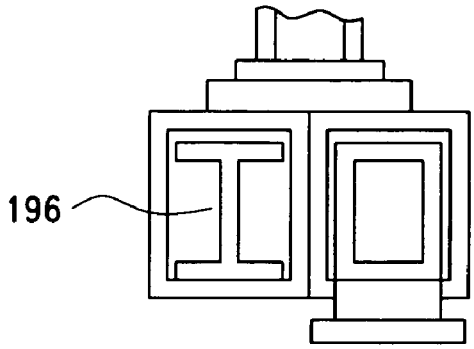
FIG. 24 is a side elevational view showing embodiments of support beams in an embodiment of a base assembly.

As shown in FIG. 24, the support beams may take the form of a variety of beams having a plurality of different cross-sectional shapes. For example, the support beams 196 may be a box beam or an I-beam. It will be understood, however, that the cross-sectional shape of the support beams 196 should be sufficiently configured so as to accommodate the aforementioned devices, assemblies, and mounts described herein and appropriate equivalents considered by a skilled artisan.

Figure 25:
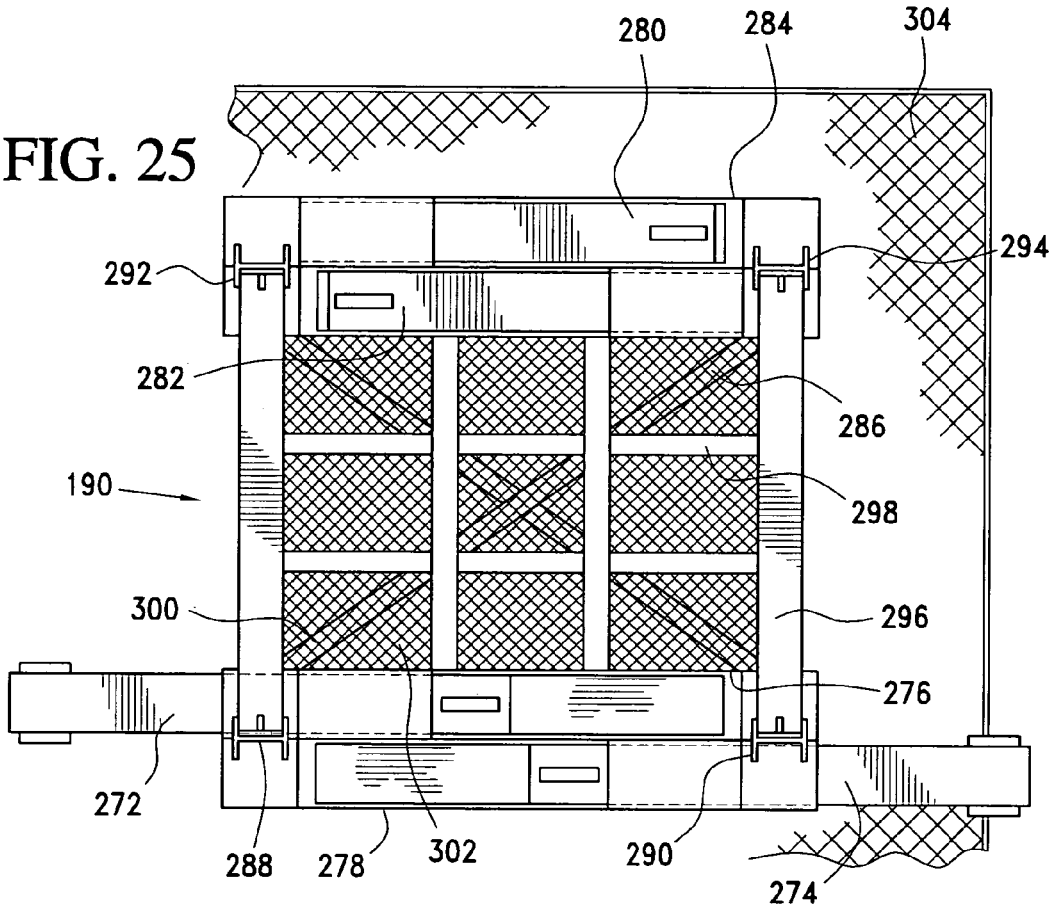
FIG. 25 is a schematic top plan view showing an embodiment of a base assembly.

FIG. 25 exemplifies an embodiment of a base assembly 190 of the inventive platform wherein support beams 272, 274 are deployed by extending from their respective housings 276, 278 along a first side of the platform, and support beams 280, 282 are retracted within their respective housings 284, 286 along a second side of the platform. As shown, the housings 272, 274, 284, 286 are mounted underneath respective column members 288, 290, 292, 294 such that the cross-section of the column members 288, 290, 292, 294 extends at least a portion over the width of the respective housings 272, 274, 284, 286.

A plurality of transverse members 298 are provided which reinforce the base assembly 190 and span the lateral members 296. Moreover, diagonal members 300 extend between diagonally opposed column members 288, 290, 292, 294, and may be provided to add support to the base assembly 190. The base assembly also includes a deck 302 bordered by the lateral members 296 and is supported by the transverse and diagonal members 298, 300. The deck 302 may be constructed from expanded metal, perforated metal, bar grating, fiberglass grating, hex metal and other suitable conventional decking materials and configurations known to one skilled in the art.

It will be understood that the inventive platform is not limited to having reinforcing transverse members and the diagonal members to merely reinforce the base assembly, but any of the levels of the inventive platform may be provided with such transverse and diagonal members to structurally reinforce the platform sections and staircases.

Safety nets 304 or other appropriate safety devices such as screens, mesh, solid panels and equivalent devices may be provided about the periphery of the base assembly 190. Moreover, it will be understood that any other level of the inventive platform may include appropriate safety nets or devices whereat such safety nets or other safety devices are desirable or necessary.

It will be noted that the base assembly may be provided with a passageway extending therethrough that provides access from below the base assembly. In particular, this particular feature is envisioned to provide access to the inventive platform for workers from manholes below the base assembly.

Figure 26:
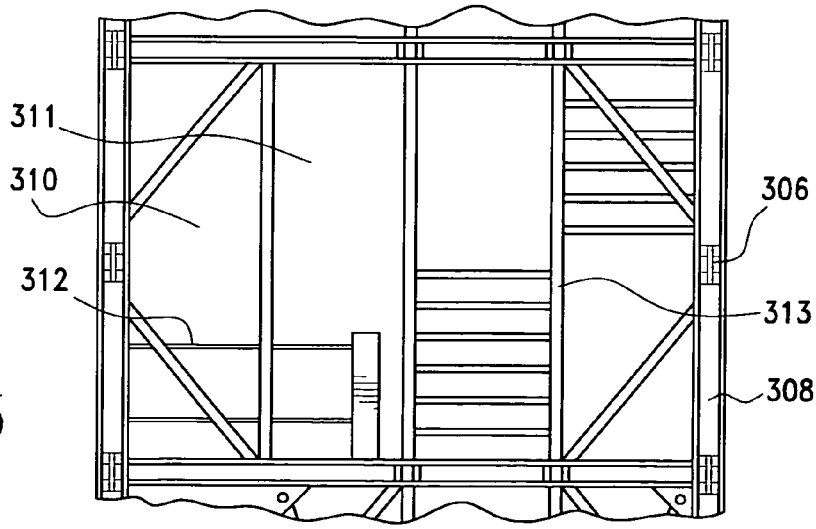
FIG. 26 is a front elevational view showing an embodiment of a level of the inventive platform.

FIG. 26 shows an embodiment of a platform including slots 306 that are vertically spaced along column members 308. The slots 306 are configured for attachment of the outriggers, such as with the aforementioned struts, in a fashion similar to those shown in FIGS. 12-14 and described above. Moreover, each level 310 of the inventive platform may include a guardrail system 312. The guardrail system 312 may include midrails, screens, mesh, intermediate vertical members, solid panels, and equivalent structural members capable of withstanding, without failure, a force applied in any downward or horizontal direction.

In the embodiment shown in FIG. 26, this level 310 is exemplary of a "double" wide portal 311. This portal 311 is defined by diagonal members 313, which when combined, form a portal having a width less than a width of diagonal members of a "single" width portal described more fully above in view of other embodiments.

FIG. 27 illustrates another embodiment of a feature of the platform of the invention. More particular, a ladder 314 may be connected to a level 316 of the platform to provide temporary entry to the level. The ladder 314 may be connected to the platform so that it either ascends to a level 316 or, in the alternative, so that it descends onto the level 316. The ladder 314 may be any type of ladder known to a skilled artisan and may be coupled or connected to the platform any known fashion. It will be noted that the ladder may be connected to any level of the platform.

FIG. 28 shows another embodiment of a feature of the inventive platform. Specifically, a trolley 318 is provided which is mountable and transportable along a trolley beam 320 connected to column members 321. The trolley 318 includes a handle 322 extending outwardly from a first roller assembly 324. The handle 322 is intended to be accessed from an upper level 326 directly above the first roller assembly 324 so as to be positioned to overhang a lower level 328 directly below. A locking pin 330 is provided which is configured to extend through a handle stem 332 of the handle 322 and into one of a plurality of bores 334 formed along the longitudinal length of the trolley beam 320 to secure the trolley 318 therewith.

The first roller assembly 324 is principally provided for transport of the trolley 318 along the trolley beam 320 and a lateral member 336 upon which the roller assembly 324 may be installed. A second roller assembly 339 may be provided which may be arranged to roll along a beam member 337 which runs transversely to lateral member 336. The trolley 318 may include a pulley 338 that extends into the lower level 328 and a tow element 340 extensible therefrom. It will be understood that the various components of the trolley 318 may be modified or replaced with components having similar functions as those described herein. Moreover, the mounting of the trolley onto the trolley beam is not limited to the method and manner described herein but may be modified as considered expedient by a skilled artisan.

As illustrated in FIG. 29, an embodiment of the inventive platform includes a top level 342. In the embodiment shown herein, the top level 342 includes an exit structure 344 leading from a staircase 346. The exit structure 344 is formed of structural members and has a roof 348 with a protective covering formed of a material such as corrugated sheet metal. Leading from the exit structure 344 is a platform section 350 which borders the exit structure 344, and may be formed of the aforementioned conventional decking materials and configurations herein described.

A safety cable 352 or guardrail system of the type herein described may be provided which surrounds the periphery of the top level 342 bounded by column members 354. The top portions 356 of the column members 354 include suitable hitch devices 358 secured thereon. The hitch devices 358 may be used to connect to a tow element 264, such as rope, chains or cables that in turn connect to a crane (not shown) for transport and placement of the platform. Other devices and methods may be used for transport and placement of the platform as would be deemed effective by a skilled artisan and which are conventionally known.

Figure 30:
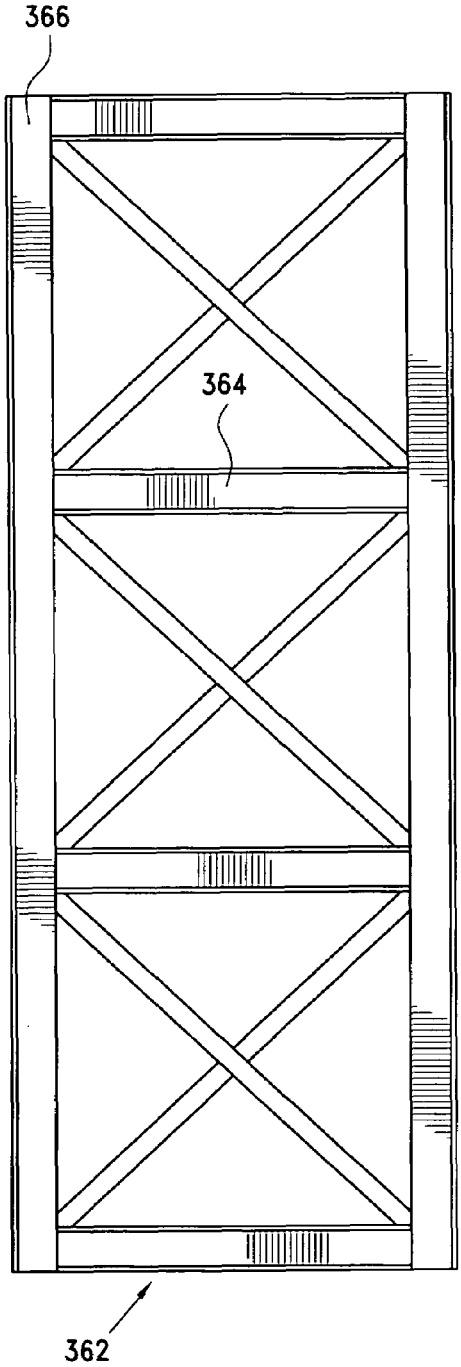
FIGS. 30 and 31 show embodiments of truss sections for use in the inventive platform.
Figure 31:
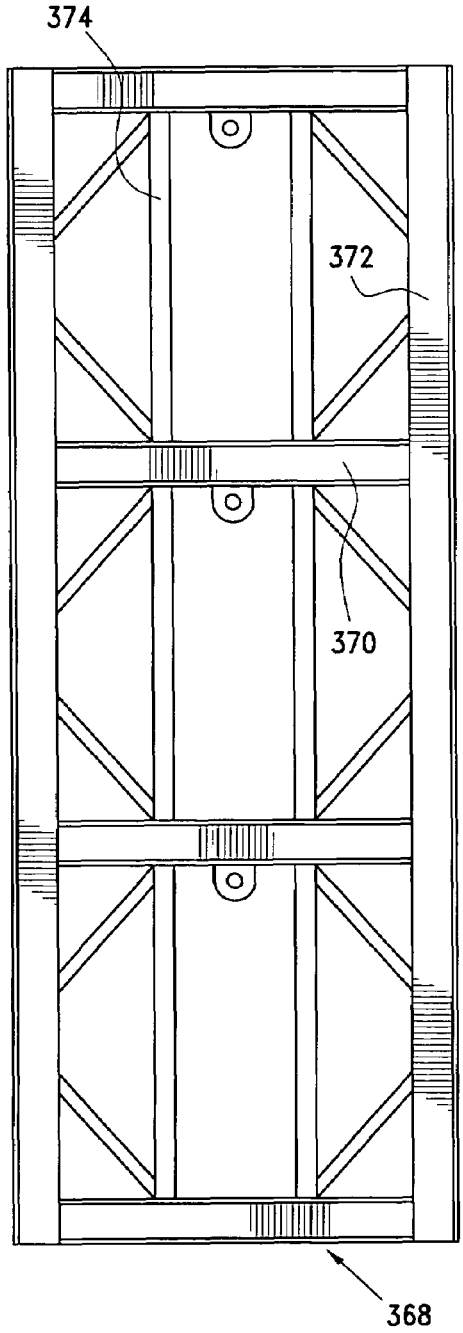

FIGS. 30 and 31 illustrate truss and structure embodiments that may be employed in the platform of the invention, and thus provided as modular components. Since the inventive platform may be offered in modular forms, different side panels may be fabricated and assembled corresponding to portions of the platform. Turning to FIG. 30, a three tier side panel truss 362 is illustrated. Truss 362 may be constructed from a variety of different structural members, including I-beams, box beams and T-irons. For example, truss 362 includes lateral members 364 defined as I-beams, and column members 366 defined as T-irons.

FIG. 31 shows a three tier side panel truss 368 having a plurality of portals 370. Similar to the truss 362 shown in FIG. 30, the lateral members 370 in the truss 368 are constructed from I-beams and the column members 372 are constructed from T-ions. Moreover, in this particular embodiment, T-irons are used to form web members 374. The selection of the support members may vary depending on the desired strength characteristics of the platform and size constraints.

As noted above, inventive platform may comprise a plurality of modular components. The components may be assembled as platform level lengths, as shown in FIGS. 3-5, or may be provided as side trusses as shown in FIGS. 30 and 31. Multiple other embodiments are envisioned and may summarily be used in erecting the inventive platform.

According to one method for erecting the inventive platform, the inventive platform is erected in a building construction. The building construction has a plurality of superimposed floor levels and a plurality of vertically extending column members located at horizontally spaced locations.

The method first involves the step of placing a first modular component having a base assembly into a cavity of building construction and securing the base platform unit against the ground. Preferably, the first modular component has at least two platform levels that correspond to floor heights of the building construction, and a staircase extending between each platform level and providing access to the platform from a ground level. Next, the method includes extending the height of the platform by installing a sequential modular platform assembly on the first platform assembly to increase the height of the platform. The method of adding the sequential modular platform assembly may be subsequently repeated to move the platform upwardly as the height of the building construction increases during construction.

It will be understood that the modular platform assemblies may be coupled according to conventional techniques for coupling structural members. Conventional techniques include welding and the use of fasteners, and the techniques used may be in accordance with the desired ease of erection and dismantle of the platform. Of course, the modular platform assemblies may possess different features, such as those described above.

Although the present invention has been described in considerable detail with reference to certain embodiments thereof, other embodiments are possible. Therefore, the spirit and scope of the appended claims should not be limited to the description of the embodiments contained herein.

I claim:

1. A multilevel access platform, the platform including a plurality of stackable modules each comprising:

a plurality of elongated column members generally parallel and coextensive;

a plurality of elongated lateral members extending transversely between and connected to the column members, the levels of the lateral members located at vertically spaced positions relative to the column members, each of the lateral members bordering a side of the module;

a plurality of platform sections each supported by one level of the lateral members;

a staircase extending between each level of the lateral members; and utility access conduits extending between and across levels of the lateral members.

2. The multilevel access platform according to claim 1, further comprising:

at least one pair of diagonal members extending between and connected to two levels of the lateral members.

3. The multilevel access platform according to claim 1, wherein the platform section of each level spans first and second opposed lateral members, and a passageway is defined adjacent to and parallel with the platform section of each level.

4. The multilevel access platform according to claim 1, wherein the staircase extending between each level of lateral members includes first and second stair segments disposed adjacently in parallel vertical planes, the first stair segment connecting to a first level of lateral members and extending about halfway between the first level lateral members and a second level of lateral members in a first direction to connect to the second stair segment extending in a second direction towards a second level of lateral members.

5. The multilevel access platform according to claim 4, wherein the first and second stair segments join halfway between the levels of lateral members to define a landing from which a user can gain entry to or can exit from the multilevel access platform.

6. The multilevel access platform according to claim 5, wherein the first and second stair segments each define a landing portion at the extremities thereof, said landing between first and second stair segments defined by juxtaposed landing portions of the first and second stair segments.

7. The multilevel access platform according to claim 4, wherein the first stair segment is located substantially midway between opposed column members along one of the lateral members.

8. The multilevel access platform according to claim 4, further comprising:

a plurality of safety cables positioned about the periphery of each level of lateral members and vertically offset therefrom in areas surrounding the first stair segment.

9. The multilevel access platform according to claim 1, further comprising:

at least one portal located between a level of lateral members, the portal defined by mutually opposed web members, each web member including a first leg extending between opposed levels of lateral members, and second and third legs inclined to the first leg and extending diagonally from adjacent ends of the first leg to one of the column members.

10. The multilevel access platform according to claim 9, further comprising:

a ladder pivotally connected to a lateral support member corresponding to the at least one portal.

11. The multilevel access platform according to claim 9, further comprising:

a ramp pivotally connected to a lateral support member corresponding to the at least one portal.

12. The multilevel access platform according to claim 9, further comprising:

a plurality of outriggers positioned about the periphery of each level of lateral members in areas surrounding the at least one portal.

13. The multilevel access platform according to claim 12, wherein each of the outriggers is pivotally connected to the lateral members, said outriggers having a deployed position defined as extending outwardly from and generally parallel with a corresponding level of the lateral members, and a stowed position defined as extending generally parallel with the column members.

14. The multilevel access platform according to claim 1, further comprising:

a platform base assembly connected at a base portion of one of the stackable modules, the base assembly including a housing supporting a plurality of support beams each extensible relative to the housing and having an anchor device at a first end thereof arranged to extend outwardly from the housing.

15. The multilevel access platform according to claim 14, further comprising:

a plurality of sliding support legs each secured at a first end thereof to the first end of each support beam and slidably connected at a second end thereof to one of the column members.

16. The multilevel access platform according to claim 14, further comprising:

a pivot plate assembly corresponding to each of the support beams, the pivot plate assembly including a lower plate member secured to the support beam and having a convex profile, and an upper plate member secured to an end portion of a column member and having a concave profile corresponding to the male profile.

17. The multilevel access platform according to claim 14, further comprising:

at least one track element disposed within the housing, each of the support beams slidably mounted upon the at least one track element.

18. The multilevel access platform according to claim 1, further comprising:

a transportable trolley slidably connected to an upper level of the lateral members and extending downwardly above a lower level of lateral members directly adjacent and vertical spaced from the upper level of the lateral members.

19. A platform comprising:

a plurality of elongated column members generally parallel and coextensive;

a plurality of levels having a plurality of elongated lateral members extending transversely between and connected to the column members, each level located at vertically spaced positions relative to the column members, and each of the lateral members bordering a side of the platform;

a plurality platform sections each supported by one level of the lateral members;

a staircase extending between each level of lateral members, the staircase including first and second stair segments disposed adjacently in parallel vertical planes, the first stair segment connecting to a first level of the lateral members and extending about halfway between the first level lateral members and a second level of the lateral members in a first direction to connect to the second stair segment extending in a second direction towards the second level of the lateral members; and a platform base assembly connected to the column members, the base assembly including a housing supporting a plurality of support beams each extensible relative to the housing and having an anchor device at a first end thereof arranged to extend outwardly from the housing.

20. The platform according to claim 19, further comprising:

at least one portal located between a level of lateral members, the portal defined by mutually opposed web members, each web member including a first leg extending between opposed levels of lateral members, and second and third legs inclined to the first leg and extending diagonally from adjacent ends of the first leg to one of the column members.

21. The platform according to claim 19, further comprising:

a plurality of sliding support legs each secured at a first end thereof to the first end of each support beam and slidably connected at a second end thereof to one of the column members.

22. The platform according to claim 19, further comprising:

a pivot plate assembly corresponding to each of the support beams, the pivot plate assembly including a lower plate member secured to the support beam and having a male profile, and an upper plate member secured to an end portion of a column member and having a female profile corresponding to the male profile.

23. The platform according to claim 19, further comprising:

at least one track element disposed within the housing, each of the support beams slidably mounted upon a track element.

24. The platform according to claim 19, wherein the first and second stair segments join halfway between the levels of lateral members to define a landing from which a user can gain entry to or can exit from the multilevel access platform.

* * * * *